US009613613B2

(12) United States Patent
Vau

(10) Patent No.: US 9,613,613 B2
(45) Date of Patent: Apr. 4, 2017

(54) METHOD FOR ACTIVE NARROW-BAND ACOUSTIC CONTROL WITH VARIABLE TRANSFER FUNCTION(S), AND CORRESPONDING SYSTEM

(71) Applicant: IXBLUE, Marly le Roi (FR)

(72) Inventor: Bernard Vau, Saint Maur Desfosses (FR)

(73) Assignee: IXBLUE, Marly le Roi (FR)

( * ) Notice: Subject to any disclaimer, the term of this patent is extended or adjusted under 35 U.S.C. 154(b) by 0 days.

(21) Appl. No.: 14/767,211

(22) PCT Filed: Feb. 11, 2014

(86) PCT No.: PCT/FR2014/050258
§ 371 (c)(1),
(2) Date: Aug. 11, 2015

(87) PCT Pub. No.: WO2014/125204
PCT Pub. Date: Aug. 21, 2014

(65) Prior Publication Data

US 2016/0005390 A1 Jan. 7, 2016

(30) Foreign Application Priority Data

Feb. 13, 2013 (FR) ..... 13 51213
Aug. 2, 2013 (FR) ..... 13 57720

(51) Int. Cl.
*A61F 11/06* (2006.01)
*G10K 11/178* (2006.01)

(52) U.S. Cl.
CPC ..... *G10K 11/178* (2013.01); *G10K 11/1786* (2013.01)

(58) Field of Classification Search
USPC ..... 381/71.1–71.14
See application file for complete search history.

(56) References Cited

U.S. PATENT DOCUMENTS 5,832,095 A * 11/1998 Daniels ..... G10K 11/1784 381/71.14
8,682,000 B2 3/2014 Vau
(Continued)

FOREIGN PATENT DOCUMENTS

DE 19505610 8/1996
WO 2010-136661 12/2010

OTHER PUBLICATIONS

Landau et al., "Adaptive narrow band disturbance rejection applied to an active suspension—an internal model principle approach," Automatica 41 (2005), pp. 563-574.

*Primary Examiner* — Maria El-Zoobi
(74) *Attorney, Agent, or Firm* — Young & Thompson

(57) ABSTRACT

An active acoustic control method for attenuating disturbing narrow-band noise with at least one counter-noise loudspeaker and at least one error microphone in a space forming a material electroacoustic system, the method implementing, in a computing element, a control law with an internal model and disturbance observer with a model of the electroacoustic system, previously obtained by an identification method. The current configuration of the electroacoustic system can vary over time, a nominal configuration of the electroacoustic system is previously determined, a corresponding nominal model $M_o(q^{-1})$ or $M_o(k)$ previously identified, the control law with an internal model and disturbance observer is implemented in real time, a modifier block $\Delta(q^{-1})$ or $\Delta(k)$ is applied to and associated with the nominal model, and the nominal model remains the same during the variations of the current configuration of the electroacoustic system, and the modifier block is varied in real time during these variations.

11 Claims, 11 Drawing Sheets

Figure 4:
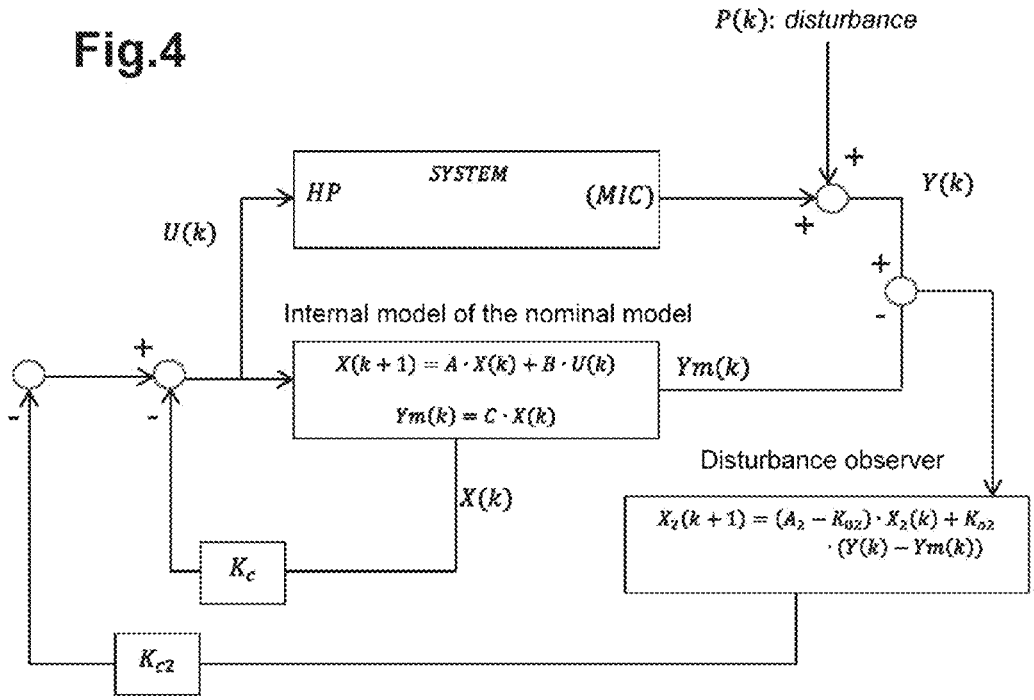

State of the art - direct adaptive control

(56) References Cited

U.S. PATENT DOCUMENTS

| | | | | |
|---|---|---|---|---|
| 2009/0132064 | A1* | 5/2009 | Ydstie | G05B 13/048 700/42 |
| 2012/0070013 | A1* | 3/2012 | Vau | G10K 11/178 381/71.4 |
| 2012/0237049 | A1* | 9/2012 | Brown | G10K 11/1788 381/71.1 |

* cited by examiner

Fig.1: State of the art - direct adaptive control
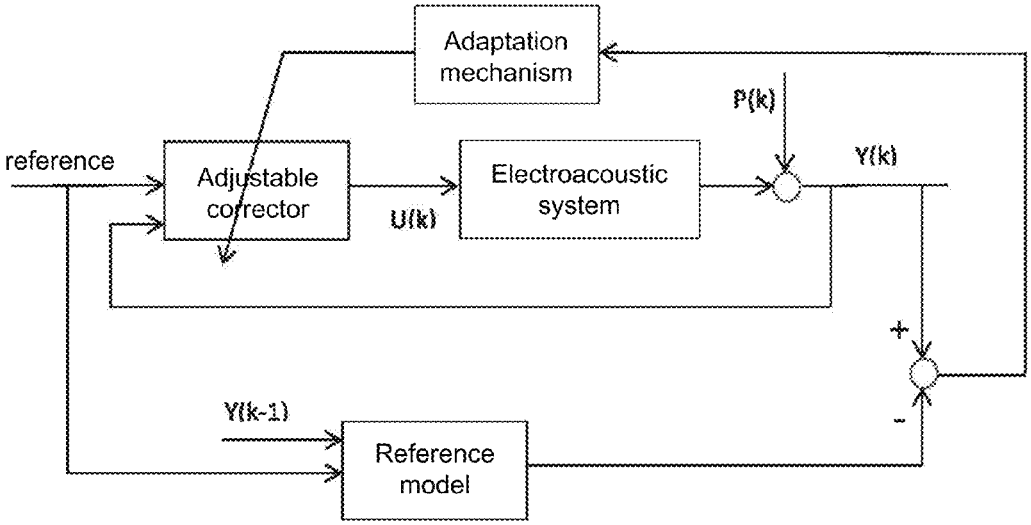
Fig.2: State of the art - indirect adaptive control
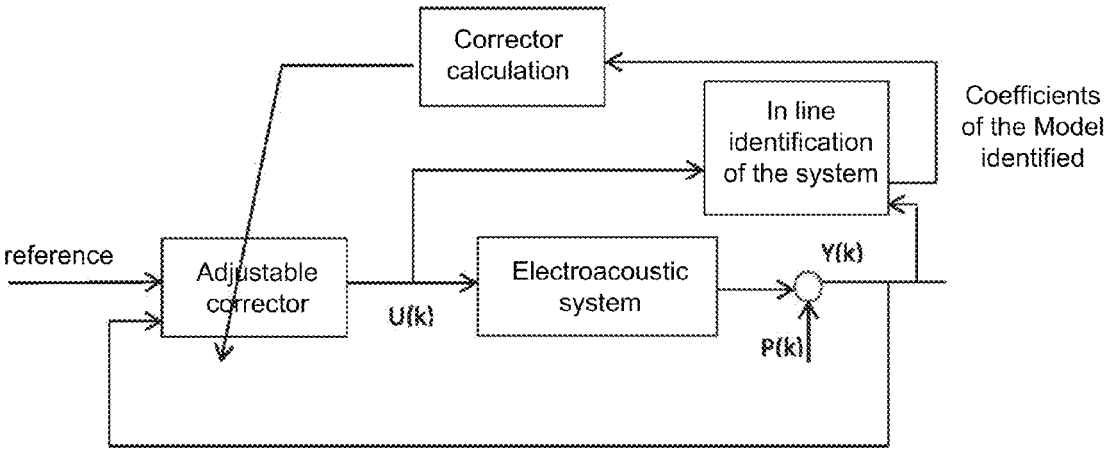

Fig.3.1: Form 1
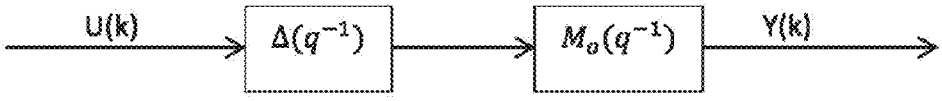
Fig.3.2: Form 2
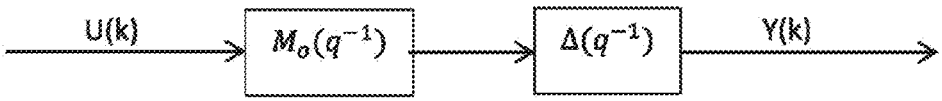
Fig.3.3: Form 3
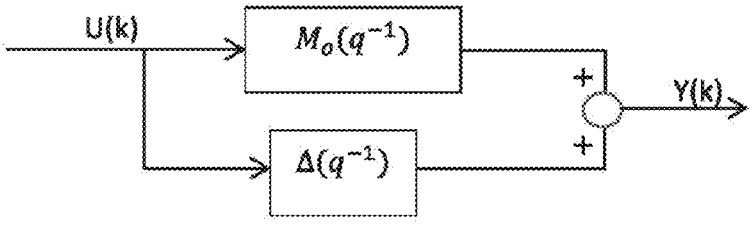
Fig.3.4: Form 4
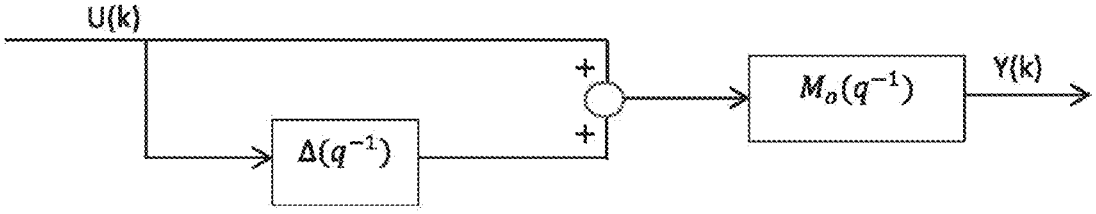
Fig.3.5: Form 5
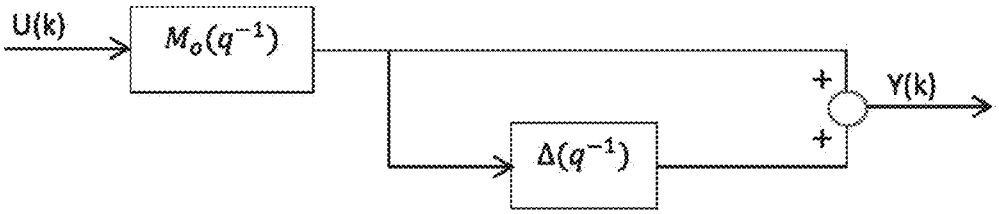

Fig.3.6: Form 6
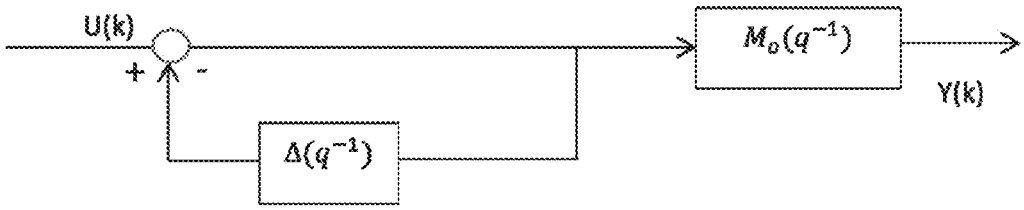
Fig.3.7: Form 7
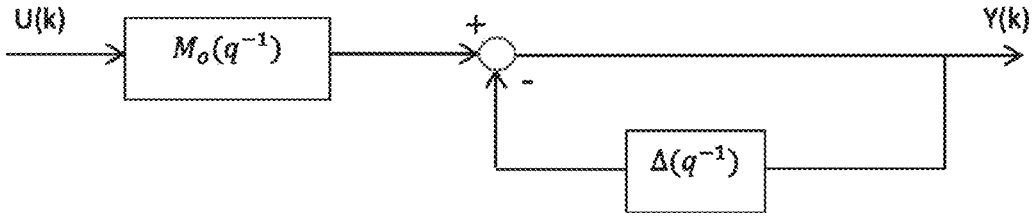
Fig.3.8: Form 8
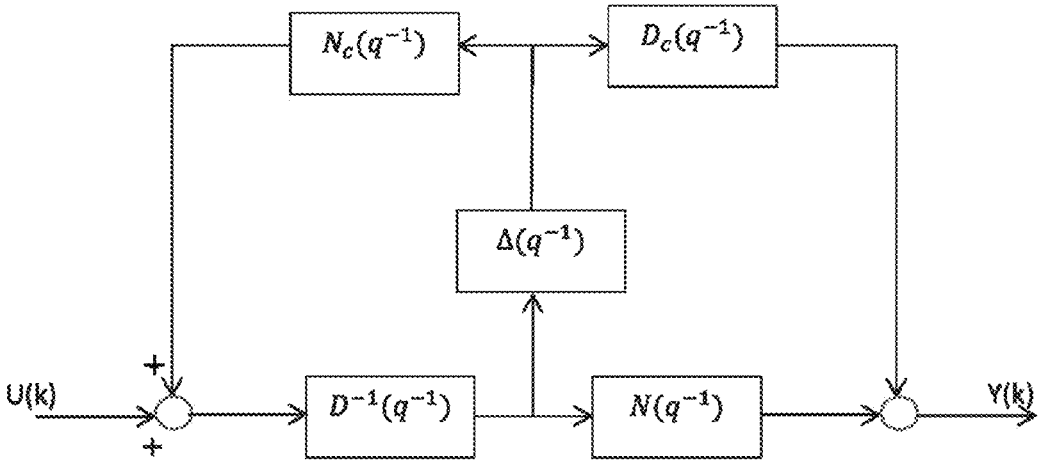

Fig.13
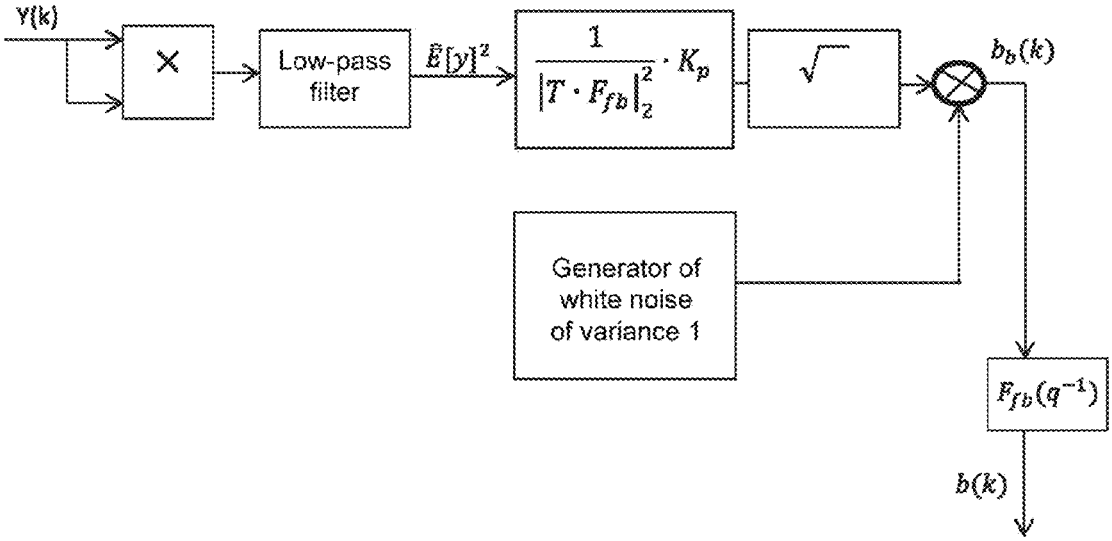
Fig.6bis
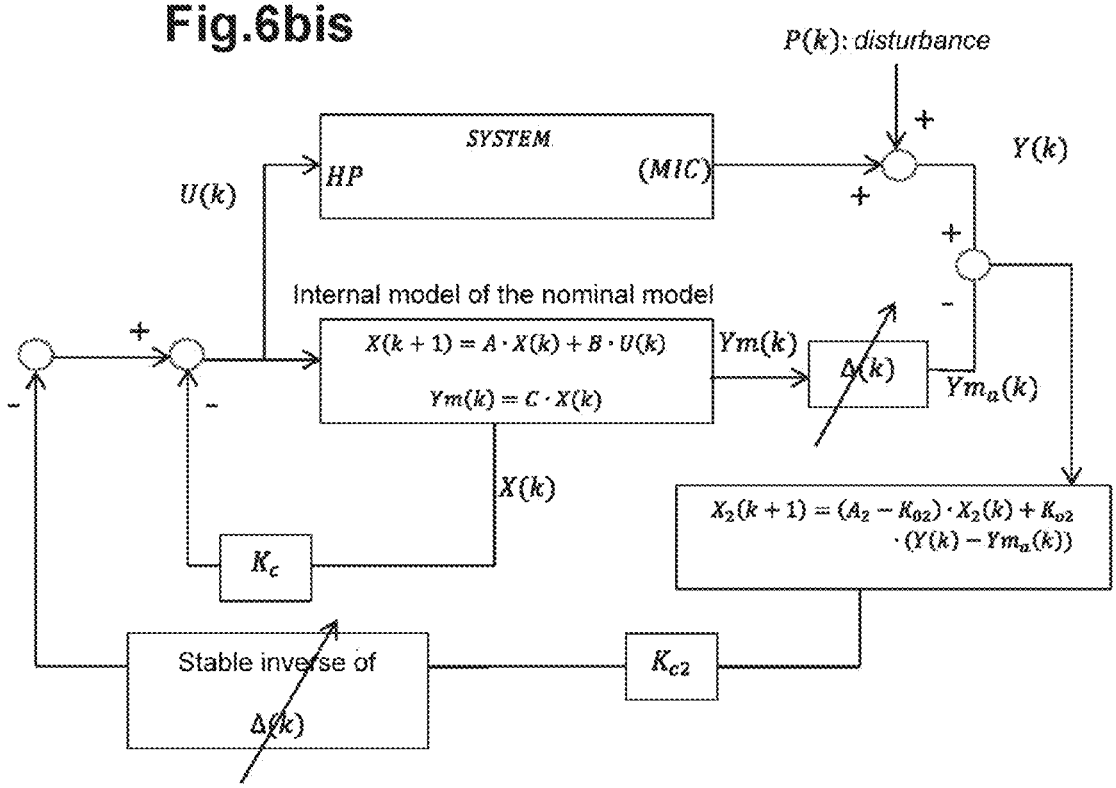

Fig.8
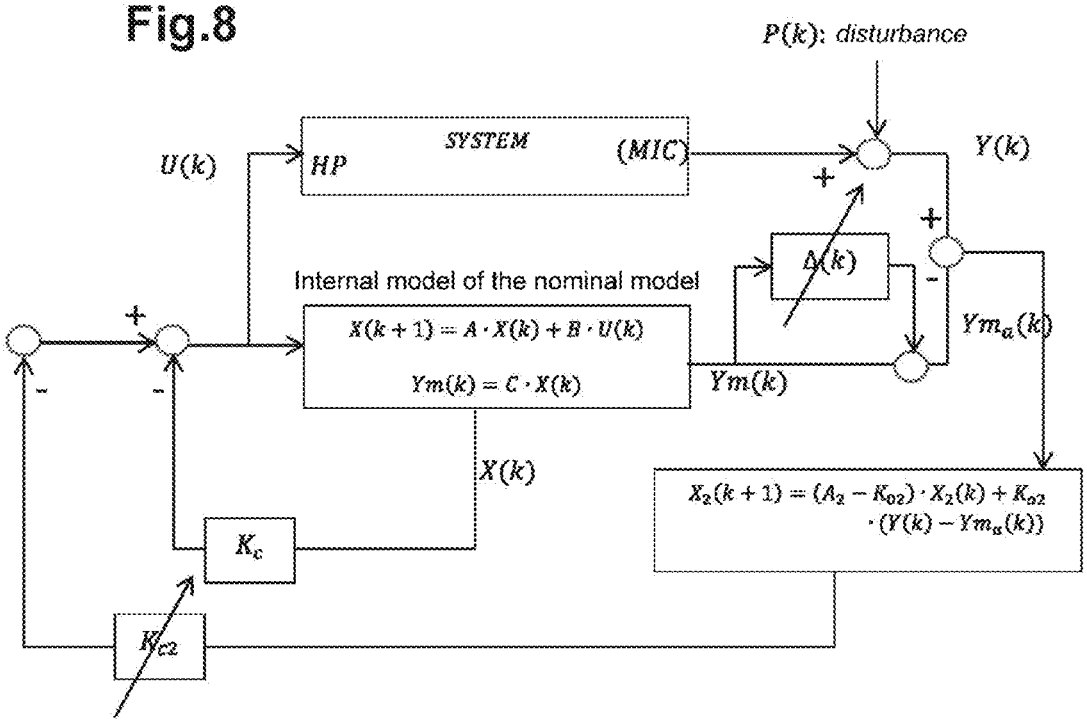
Fig.9
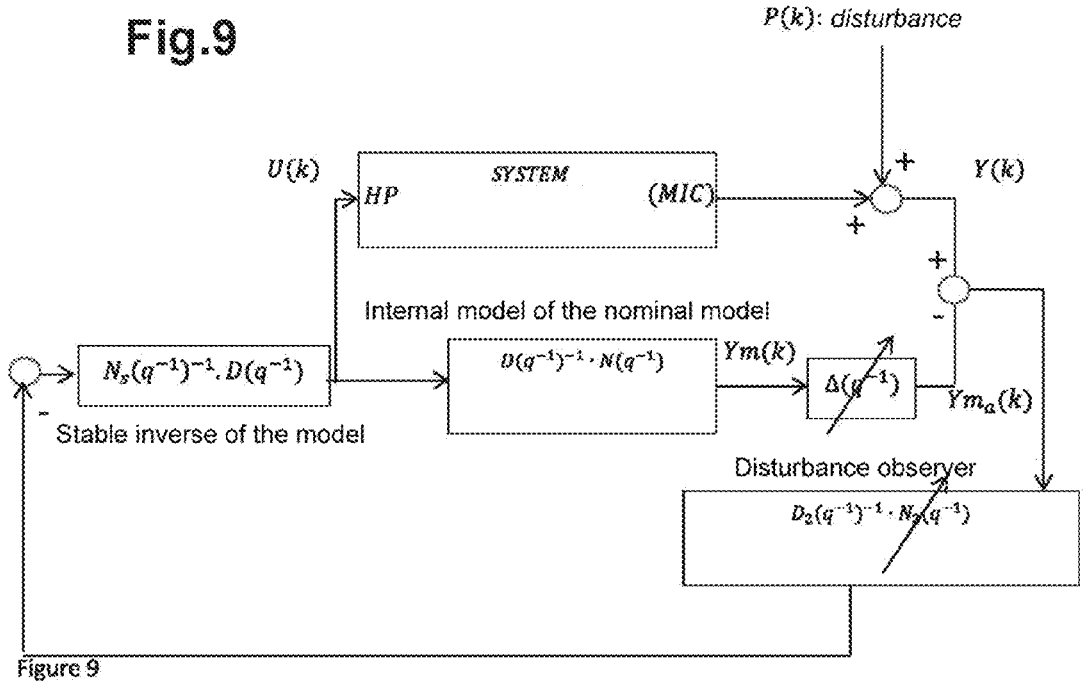
Figure 9

METHOD FOR ACTIVE NARROW-BAND ACOUSTIC CONTROL WITH VARIABLE TRANSFER FUNCTION(S), AND CORRESPONDING SYSTEM

BACKGROUND OF THE INVENTION

Field of the Invention

The present invention relates to a method for active acoustic control of narrow-band disturbing noise(s) implementing a model of an electroacoustic system of a space in which the disturbing noise to be attenuated/cancelled is present. This electroacoustic system corresponds to a space including one/several loudspeaker(s) for generating counter-noises and one/several error microphone(s) for acoustic measurements in said space. The invention is particularly adapted to the case where the electroacoustic system varies over time. The variation of the electroacoustic system, and hence of the model that represents it, may be due, for example, to a displacement in the space of the source(s) of disturbing noises and of the error microphone(s) or to a change in the configuration of this space and/or in the position of the objects it contains. In practice, the method may implement one/several transfer function(s), a transfer matrix, or a state representation of the model of the electroacoustic system. The object of this method is to obtain at least attenuation, or even cancelling, of the disturbing noises, in particular in a zone of the space in relation with the error microphone(s).

Description of the Related Art

The transfer between the counter-noise loudspeaker(s) and the error microphones in the electroacoustic system is generally called "secondary path transfer" and this denomination will be used hereinafter.

The variations of the secondary path transfer may be due to several factors, in particular:

- a variation of configuration of the space around the counter-noise loudspeakers and the error microphones, according to the arrangement of the objects and/or the people located in this space;
- a modification of the loudspeaker(s) or the microphone(s) due for example to an ageing of these elements;
- a modification of position of the loudspeaker(s) or the microphone(s), and, in this latter case, due to the fact that the microphone(s) are placed on a person who moves in space and who wishes to be protected to from the disturbing noise.

It is known that two main classes of active control algorithms exist:

1) The "feedforward" algorithms, which require the use of a reference source correlated with the disturbing noise perceived at the error microphone(s). This reference measurement serves to feed a filter whose output is the control signal of the counter-noise loudspeaker(s). The coefficients of the filters being adjusted in real time/in line by means of an adaptive device. The algorithms of the LMS series (Fx-LMS, etc.) belong to this class.

2) The "feedback" algorithms, in which only the measurements of the error microphones are used as an input for the algorithm, independently of any reference.

The problem that this invention proposes to solve relates to the rejection of narrow-band disturbing noises by means of a feedback algorithm and when the secondary path transfer varies over time, in particular for the above-mentioned reasons.

During the feedback synthesis of a linear corrector, the margin of robustness of the corrector control law is known from the design. In the single-variable case, this level of robustness may be evaluated in particular by means of the gain, phase, module, delay margins, etc.

In the case of a narrow-band noise rejection, a conventional linear control law with invariant parameters (LTI) produces naturally a phase margin $M\phi$ that cannot exceed 90° in absolute value and whatever the methodology of synthesis of said control law. As a consequence, if the phase of secondary path transfer comes to vary more than $M\phi$, the loop becomes instable and a Larsen effect is obtained.

In a lot of cases, the natural robustness of a LTI control law is insufficient when the secondary path transfer varies significantly, which strongly limits the applications of the active control in the practice, when it is compelled to use only electroacoustic systems of the LTI or quasi-LTI type.

To that, it must be added that the variations of the secondary path transfer are all the more important that the frequencies of interest, which correspond to the frequencies of rejection, are high, which is one of the reasons for which the active acoustic control is used generally only for the low frequencies.

In order to solve the problem of active control of electroacoustic systems whose secondary path transfer varies significantly over time, two automation approaches exist in the literature:

1) The Adaptive Control:

The adaptive control is, as its name indicates, a control law where the corrector coefficients are adapted over time as a function of the variation of the coefficients of the transfer function or of the transfer matrix, of the system to be controlled.

Two sub-categories of adaptive control exist, as mentioned in the document Landau et al., "Adaptive control", Springer, 2011:

a) The direct adaptive control where the coefficients of the controller are calculated so that the closed loop tends, as far as the dynamics is concerned, to be similar to the dynamics of a reference model. Unfortunately, this method requires that all the zeros of the transfer function are in the unit circle, which has little chance to occur in practice for an electroacoustic system. The scheme of principle of the direct adaptive control is given in FIG. 1 of the state of the art.

The signals indicated in this FIG. 1 and in the remaining of this document are the following (in the case of a time representation):

- U(k) is the control signal, or the vector of control signals, of the counter-noise loudspeakers;
- Y(k) is the signal, or the vector of signals, of the measurements of the error microphones;
- P(k) is the signal equivalent to the disturbing noise to be rejected at the error microphone(s).

b) The indirect adaptive control, which is consisted of two stages:

- a stage of identification of model in line, real time, of the system parameters producing the coefficients of the model identified;
- a stage of calculation in line, real time, of the corrector parameters based on the model identified in real time by its model coefficients.

The scheme of principle of the indirect adaptive control is given in FIG. 2 of the state of the art.

This indirect adaptive control scheme is in theory usable within the framework of the narrow-band active control. Unfortunately, the obstacles linked to the implementation of this principle are essentially of practical order. Indeed, an electroacoustic system is by nature a system with distributed parameters, i.e. whose number of state variables is theoretically infinite. When these systems are modelled by means of finite-dimension models, in particular by transfer function (s), state representation . . . , the number of variable coefficients or states of the model is necessarily high and the corresponding transfer functions are hence of high order. For example, for a single-variable system, it is not rare to have models of order 15 or 20, i.e. 30 or 40 variables. For a multi-variable system, the number of variables may easily exceed one hundred. In the context of the adaptive control, this implies that this hundred, or more, of variable is identified in real time/in line, which, taking into account the sampling frequencies generally used, several thousands of Hz, leads to a volume of calculation that is fully redhibitory for a calculation in real time and an acceptable cost.

The difficulties linked to the volume of calculation are further increased when considering that the corrector parameters must also be calculated from the parameters of the identified model of the electroacoustic system corresponding to the secondary path transfer. This step induces significant intermediate calculations as, for example, solving a Bézout equation for a RST corrector by pole placing or solving a Riccati matrix equation in the case of quadratic-optimization control laws, etc. In practice, these calculations are performed offline with CAD tools (Matlab, Scilab . . . ) which cannot be integrated in real time systems. The size of the model and hence of the corrector makes these corrector synthesis calculations still harder to perform in real time.

Hence, the implementation in real time of an adaptive control such as described in the literature is almost not possible in practice.

2) The Multi-Model Control:

In this principle of control, n models $M_i$ are identified for the various configurations of the system. For example, if the error microphones are mobile, different model identifications are performed in various possible locations for said microphones.

For each model, a corrector is synthesized and the control law is based on the selection, in real time/in line, of the good corrector according to the present/current configuration of the electroacoustic system, and in particular, of the location of the loudspeakers, of the microphones, of the arrangement of the zone to be controlled, etc. On the other hand, the identification of the models and the synthesis of the correctors may be performed beforehand, not in real time.

In the case of mobile microphones, the choice in real time of the good corrector may be made by determining the current position of the error microphone(s) in the space, with an external detection system, and the model and the corrector chosen are those which have been previously obtained at a point that is the closest to the current position.

It is also possible to estimate in real time the "proximity" of the behaviour of each of the models $M_i$ previously identified with the current behaviour of the electroacoustic system and to choose the corrector based on the model that is the closest to the current electroacoustic system, at a given instant. This requires the injection of an additive noise into the control loop. These techniques have been described in the patent application FR12/62353, whose inventor is B. VAU and which has been filed by the IXBLUE company. A description of the general principle of the multi-model control may also be found in the document Landau et al., "Adaptive control", Springer, 2011.

One of the drawbacks of this latter approach lies in that the number of models may very easily become too high if the configurations of the electroacoustic system are numerous. For example, in the case of mobile microphones as described in the patent application FR12/62353, it is compelled to perform a meshing of points in the space, wherein, at each point of the meshing, a model is identified and the corrector corresponding to the model is synthesized, which may be performed beforehand, not in real time.

On the other hand, in case of application in real time of the models and correctors obtained, if their number increases too much, the volumes of data and of calculation may here also become prohibitive for a processing in real time, and in particular, in applications requiring an on-board calculator, for example in a vehicle.

SUMMARY OF THE INVENTION

Hence, the present invention is intended to overcome the drawbacks of the two previous methods, and in particular the drawbacks linked to a too significant volume of calculations in real time, in order to make it possible for the control law to be integrated in a calculator of moderated cost.

Hence, the invention relates to an active acoustic control method intended to attenuate in frequency one/several narrow-band disturbing noises, in a configuration of a space, said space including:

- at least one source of narrow-band disturbing noise,
- at least one counter-noise loudspeaker intended to produce a counter-noise in said space as a function of a loudspeaker control signal U(k), and
- at least one error microphone intended to measure the sounds in said space and producing a measurement signal Y(k), the attenuation occurring essentially in the vicinity of the error microphone(s), said space with its loudspeaker(s) and its microphone(s) forming a physical electroacoustic system, said method including a calculation in real time, in a calculation means, of the control signal U(k) as a function of the measurement signal according to a control law with internal model and disturbance observer, said control law implementing a model of the electroacoustic system, wherein said model of the electroacoustic system has been previously obtained by a model identification method.

According to the invention, the current configuration of the physical electroacoustic system is varied over time, which leads to a modification of the current model $\tilde{M}(q^{-1})$ or $\tilde{M}(k)$ of the physical electroacoustic system with respect to the previously identified model, and a nominal configuration, also called median configuration, of said physical electroacoustic system is previously determined and a so-called nominal model $M_o$ $(q^{-1})$ or $M_o(k)$ corresponding to said nominal configuration of said physical electroacoustic system is previously identified, and the internal-model and disturbance-observer control law in which a modifier block $\Delta(q^{-1})$ or $\Delta(k)$ is associated with the nominal model is implemented in real time, said modifier block being interconnected/applying to said nominal mode, and the nominal model is left unchanged during the variations of the current configuration of the physical electroacoustic system and the modifier block is varied in real time during the variations of the current configuration of the physical electroacoustic system so as to adapt in real time the internal-model control law to the current configuration of the physical electroacoustic system, the current model $\tilde{M}(q^{-1})$ or $\tilde{M}(k)$ of the current configuration of the physical electroacoustic system being considered as being equal to the nominal model $M_o(q^{-1})$ or $M_o(k)$ interconnected to the modifier block $\Delta(q^{-1})$ or $\Delta(k)$.

It is understood that, due to the fact that only one model, the nominal model, is implemented in the control law, a single corrector is present in said control law. Moreover, as far as the internal model is concerned, due to the fact that the modifier block, of simplest structure than the model of the electroacoustic system, is led to vary, the calculations of the control law are simplified with respect to a control law with no modifier block in which the model of the electroacoustic system should vary. The model of the electroacoustic system, nominal model in this case, has hence been previously obtained by a model identification method and this model corresponds to an input-output relation called secondary path transfer. On the other hand, the term "is interconnected" in the passage "nominal model $M_o(q^{-1})$ or $M_o(k)$ interconnected to the modifier block $\Delta(q^{-1})$ or $\Delta(k)$" must be understood as corresponding to an application/operation/calculation allowing to modify the response/result of the nominal model. Moreover, besides the fact that the current configuration of the physical electroacoustic system may be varied over time, this configuration may vary for other reasons than voluntarily (for example, ageing of the components) and it may hence be considered that, more generally, the current configuration of the physical electroacoustic system may vary over time.

In various embodiments of the invention, the following means, which can be used alone or in any technically possible combination, are used:

- the internal-model and disturbance-observer control law is feedback based,
- the modifier block includes a number of variable coefficients lower than the number of coefficients of the model which should vary if the model alone, with no modifier block in the control law, was adapted in real time to the variations of the electroacoustic system,
- the disturbance observer includes variable coefficients,
- in the case of a state representation, the disturbance observer state feedback matrix or gain $K_{c2}$ has variable coefficients,
- the internal-model and disturbance-observer control law is based on an internal-model control method,
- in the internal-model control law, the stable inverse of the modifier block is implemented,
- in the internal-model control law with implementation of the stable inverse of the modifier block, this inverse is variable, the gain $K_{c2}$ being made fixed,
- in the internal-model control law with implementation of the stable inverse of the modifier block, this inverse is made fixed, the gain $K_{c2}$ being made variable,
- in the internal-model control law with implementation of the stable inverse of the modifier block, this inverse is variable as well as the gain $K_{c2}$,
- in the internal-model control law, the stable inverse of the modifier block is omitted,
- in the internal-model control law, the stable inverse of the modifier block is replaced by a filter,
- in the internal-model control law, the stable inverse of the modifier block is replaced by a fixed-coefficient filter,
- in the internal-model control law, the stable inverse of the modifier block is replaced by a variable-coefficient filter, the gain $K_{c2}$ being made fixed,
- the internal-model control method is the Morari control method,
- the Morari internal-model control method is implemented and, preferably, in said Morari internal-model control law, the stable inverse of the modifier block is omitted,
- the modifier block is chosen among the finite impulse response filters or the infinite impulse response filters,
- the application of the modifier block to the nominal model corresponds to one of the following operations:
  - modifier block placed at the entrance: $\tilde{M}(q^{-1})=M_o(q^{-1})\cdot\Delta(q^{-1})$
  - modifier block placed at the exit: $\tilde{M}(q^{-1})=\Delta(q^{-1})\cdot M_o(q^{-1})$
  - additive modification: $\tilde{M}(q^{-1})=M_o(q^{-1})+\Delta(q^{-1})$
  - multiplicative modification at the entrance: $\tilde{M}(q^{-1})=M_o(q^{-1})\cdot(1+\Delta(q^{-1}))$
  - multiplicative modification at the exit: $\tilde{M}(q^{-1})=(1+\Delta(q^{-1}))\cdot M_o(q^{-1})$
  - multiplicative modification on the denominator at the entrance: $\tilde{M}(q^{-1})=M_o(q^{-1})\cdot(1+\Delta(q^{-1}))^{-1}$
  - multiplicative modification on the denominator at the exit: $\tilde{M}(q^{-1})=(1+\Delta(q^{-1}))^{-1}\cdot M_o(q^{-1})$
  - dual Youla parameterization:

$$\tilde{M}(q^{-1}) = \frac{N(q^{-1}) + \Delta(q^{-1})\cdot N_c(q^{-1})}{D(q^{-1}) - \Delta(q^{-1})\cdot D_c(q^{-1})}$$

with $M_o(q^{-1})=D^{-1}(q)\cdot N(q)$ and considering a corrector $C_{corr}=D_c^{-1}(q^{-1})\cdot N_c(q^{-1})$,
- the modifier block varies in real time as a function of the results of a parametric adaptation by a closed-loop identification performed in real time/in line between, on the one hand, the internal-model control law applied to the physical/real electroacoustic system and, on the other hand, the internal-model control low applied to the modelled and nominal electroacoustic system resulting from the previous model identification of the nominal system and with application of the modifier block to said nominal model in replacement of the disturbing noise(s) P(k),
- the method of previous model identification of the electroacoustic system model is performed offline,
- the method of previous model identification of the nominal model consists, firstly, in exciting the electroacoustic system in its nominal configuration with an excitation control signal and in measuring the response of said system by the measurement signal while recording said signals, and secondly, in exploiting said recorded signals with a method of identification ptimizati n to produce the nominal model,
- the nominal model is expresses as a transfer function or as a transfer matrix or by a state representation,
- a multi-model control law is further implemented with means for memorizing a set of variable elements of the control law, including the modifier block, and means for selecting elements in real time among said variable elements so as to select for the control law the variable elements corresponding to the current state of the physical electroacoustic system,
- the selection means are of the external type, in particular with sensors arranged in the space of the physical electroacoustic system,
- the selection means are of the internal type, with means for comparing the corrector responses with respect to the physical electroacoustic system,
- the selection means are of the mixed type, external and internal,
- the variable elements are chosen among: the modifier block, the gain, the stable inverse of the modifier block, the disturbance observer,
- during the memorization, with each memorized variable element or group of variable elements is associated at least one corresponding electroacoustic system configuration data element, the multi-model control law is further extended to several nominal models, each nominal model having one or several modifier blocks, gains, inverses of modifier blocks, disturbance observers according to the case.

The invention also relates to an active acoustic control system intended to attenuate in frequency one/several narrow-band disturbance noises in a configuration of a space, said space including:

at least one source of narrow-band disturbing noise, at least one counter-noise loudspeaker intended to produce a counter-noise in said space as a function of a loudspeaker control signal U(k), and at least one error microphone intended to measure the sounds in said space and producing a measurement signal Y(k), the attenuation occurring essentially in the vicinity of the error microphone(s), said space with its loudspeaker(s) and its microphone(s) forming a physical electroacoustic system, the system including a means for calculating in real time the control signal U(k) as a function of the measurement signal according to a control law with internal model and disturbance observer, said control law implementing a model of the electroacoustic system, wherein said model of the electroacoustic system has been previously obtained by a model identification method.

The control system is characterized in that the current configuration of the physical electroacoustic system varies over time, which leads to a modification of the current model $\tilde{M}(q^{-1})$ or $\tilde{M}(k)$ of the physical electroacoustic system with respect to the previously identified model, a nominal configuration of said physical electroacoustic system having been previously determined and a so-called nominal model corresponding to said nominal configuration of said physical electroacoustic system having been previously identified, the system includes a calculation means for implementing the method of the invention, and in particular, in real time, of the internal-model and disturbance-observer control law in which a modifier block is associated with the nominal model, said modifier block being interconnected/applying to said nominal model, and said means leaving unchanged the nominal model during the variations of the current configuration of the physical electroacoustic system and varying in real time the modifier block during the variations of the current configuration of the physical electroacoustic system so as to adapt in real time the control law to the current configuration of the physical electroacoustic system, the current model $\tilde{M}(q^{-1})$ or $\tilde{M}(k)$ of the current configuration of the physical electroacoustic system being considered as being equal to the nominal model $M_o(q^{-1})$ or $M_o(k)$ interconnected to the modifier block $\Delta(q^{-1})$ or $\Delta(k)$.

The invention also relates to a computer medium including a computer program for the calculation means of the control system of the invention, for implementing the method of the invention. The calculation means is a computer calculation means.

The invention finally relates to a recording medium readable by a computer-type calculation means on which is recorded a computer program comprising program code instructions for performing steps of the method of the invention.

BRIEF DESCRIPTION OF THE DRAWING FIGURES

Figure 5:
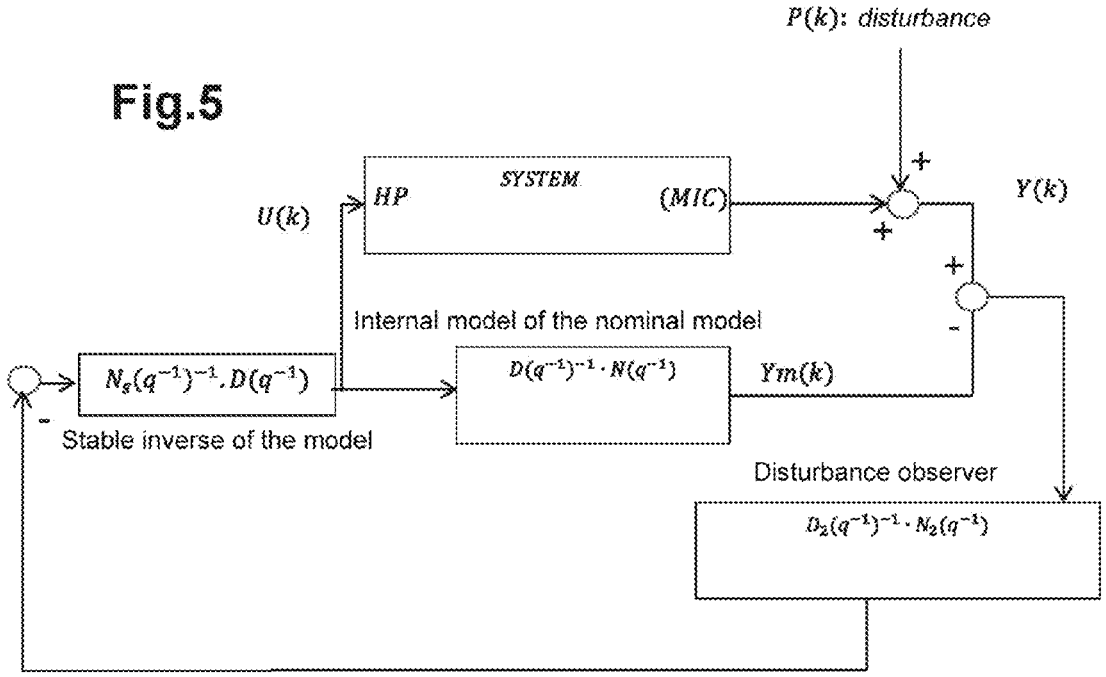
Figure 6:
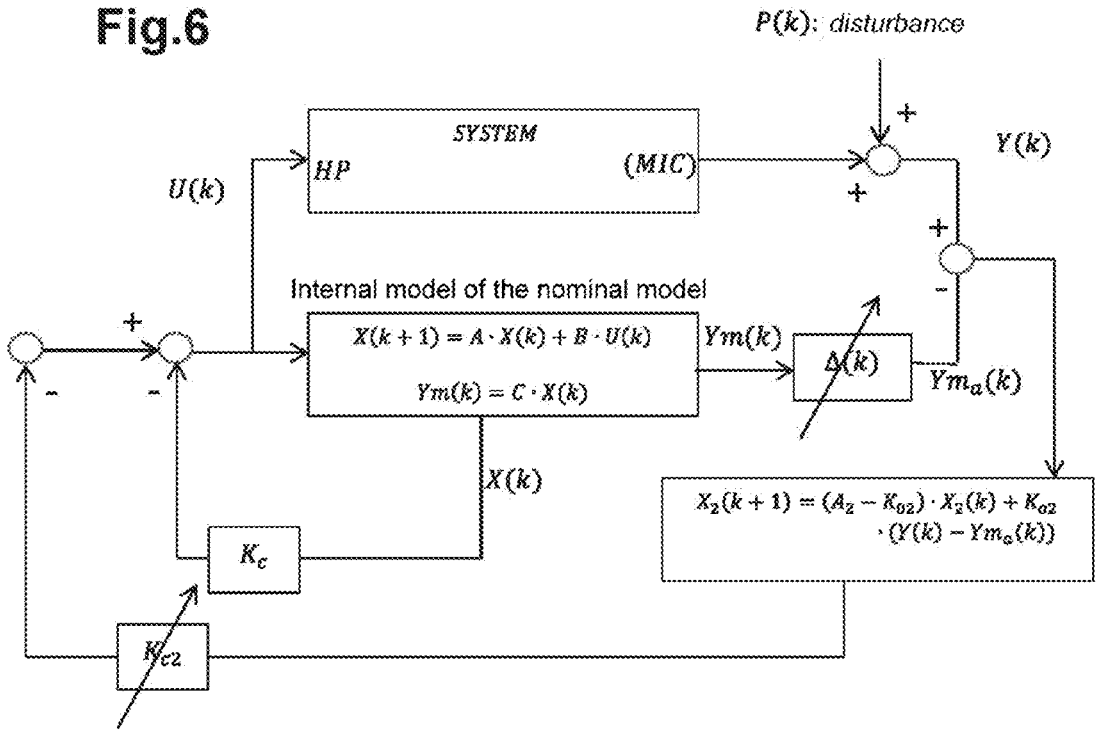
Figure 7:
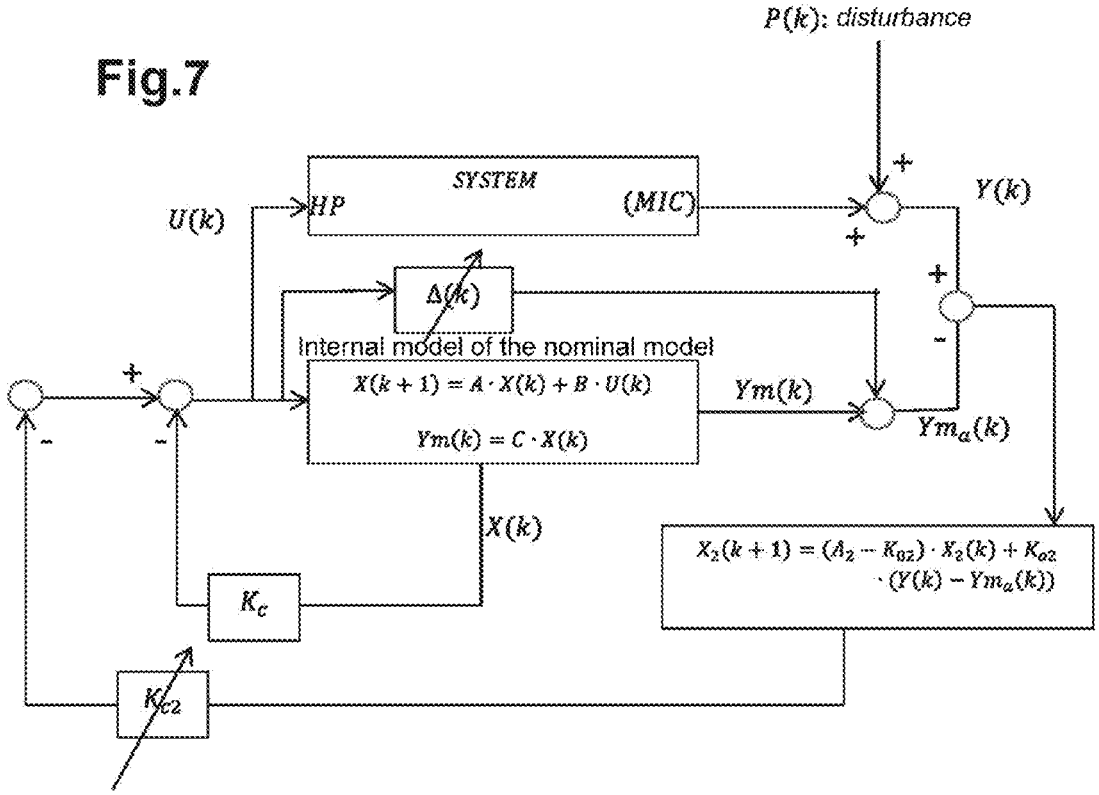
Figure 10:
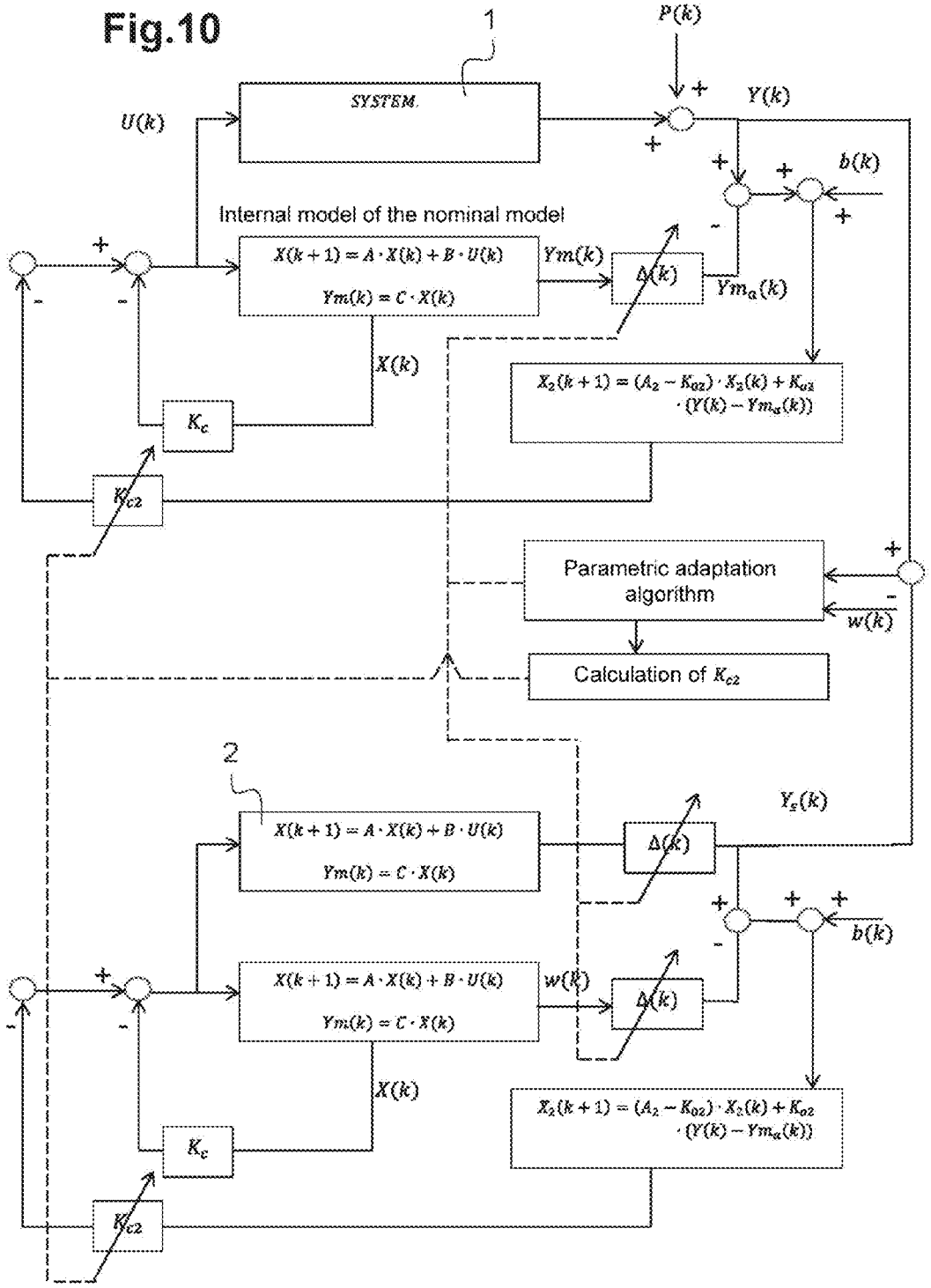
Figure 11:
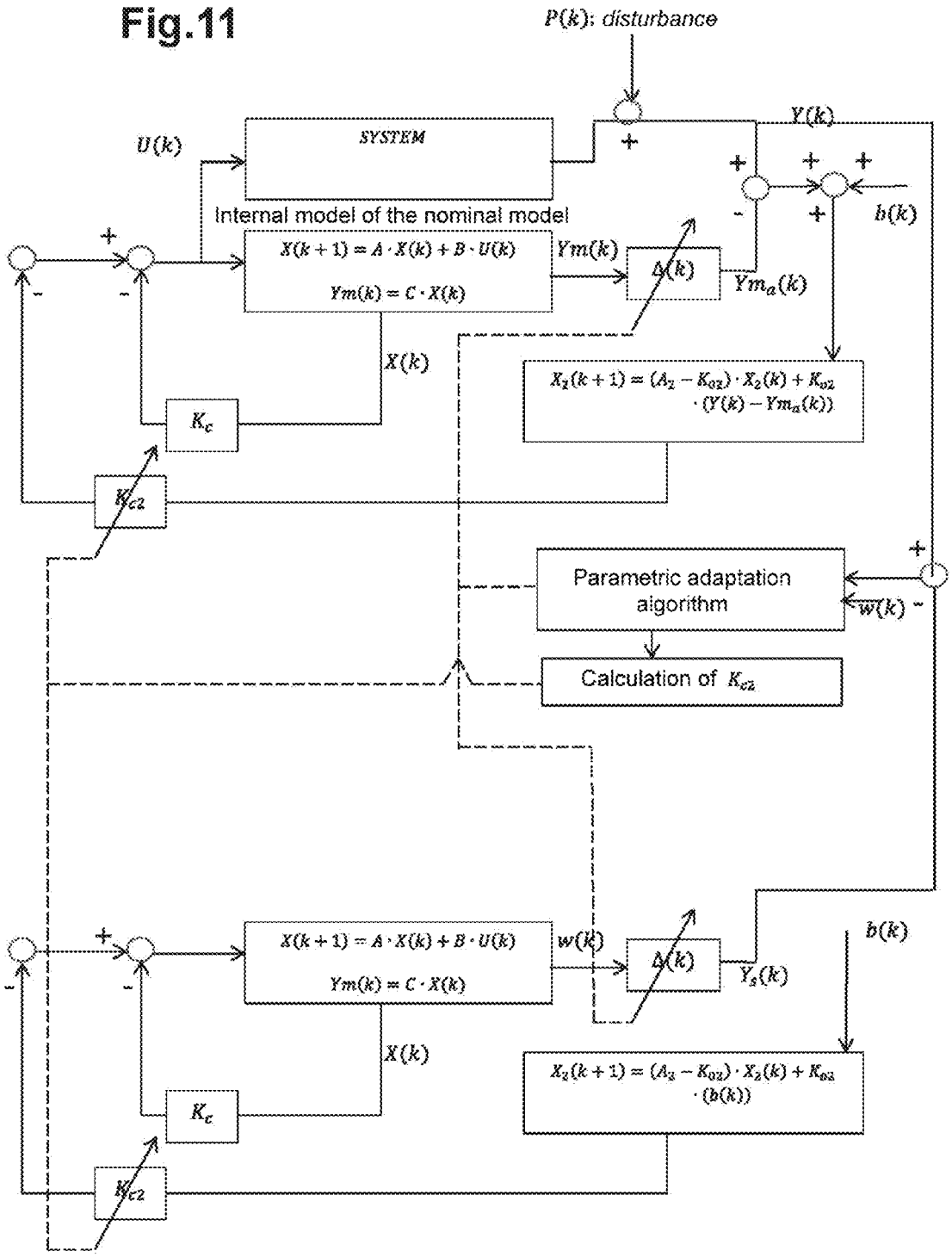
Figure 12:
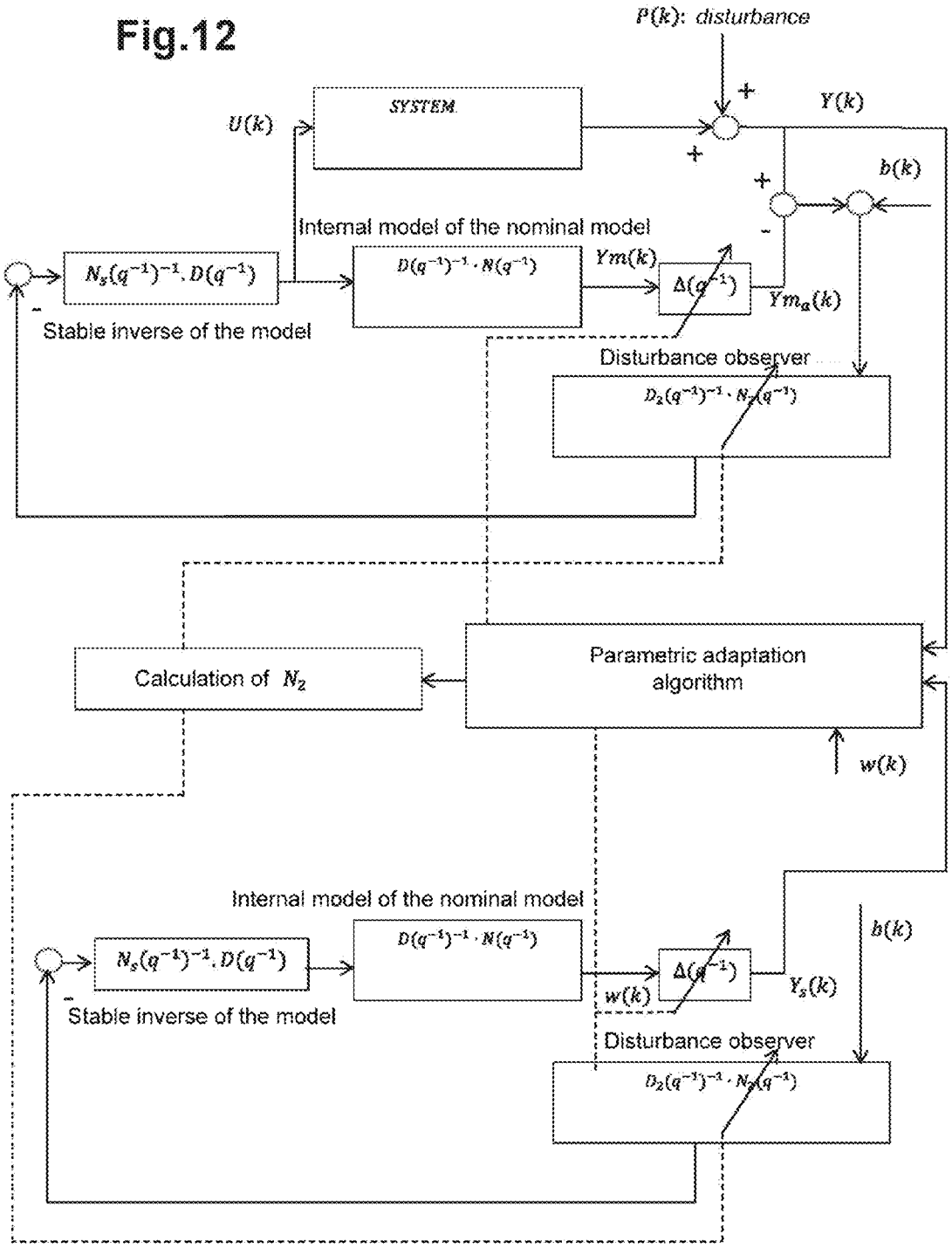
Figure 14:
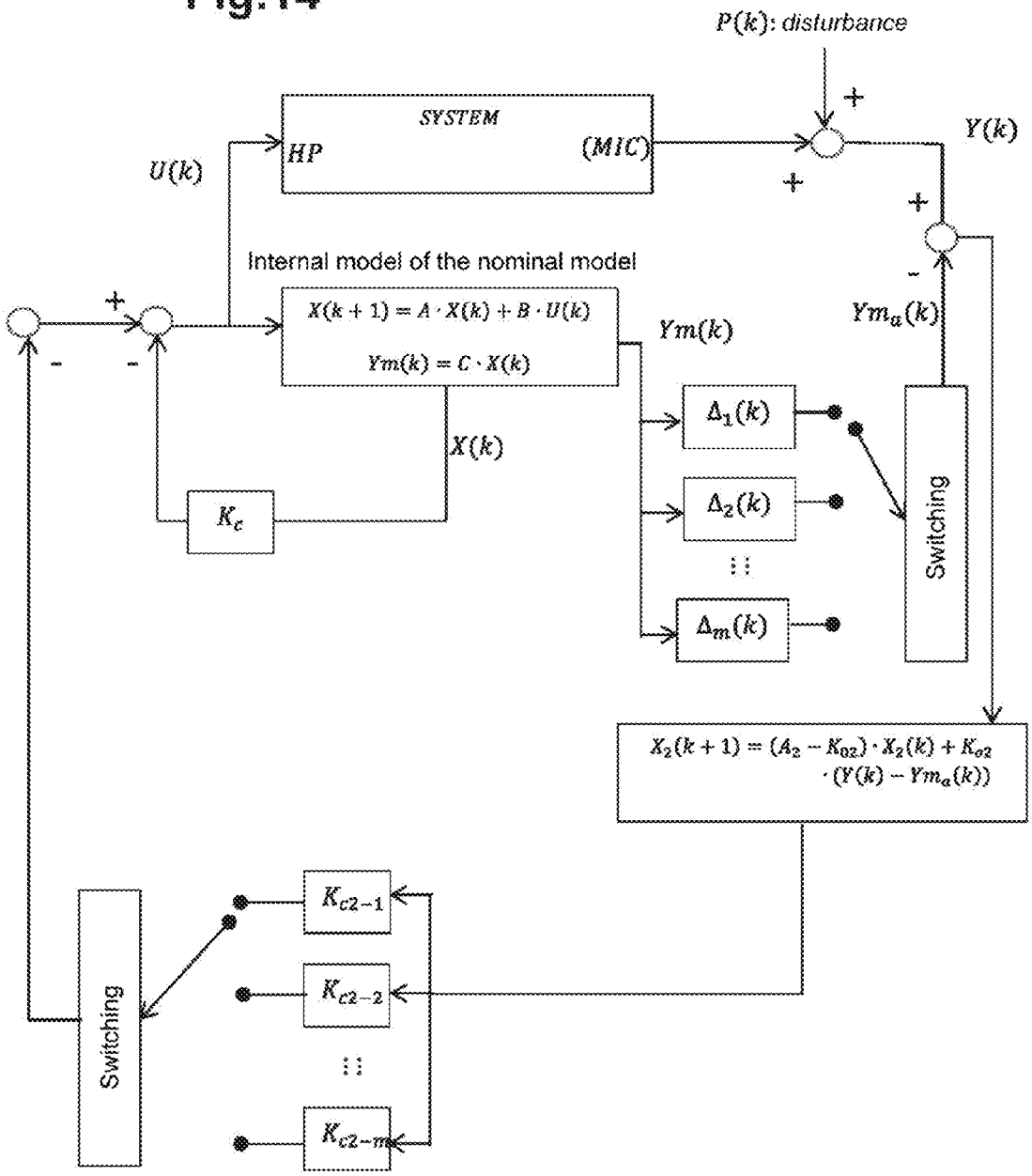

The present invention will now be exemplified, without being limited thereby, by the following description of embodiments and implementations in relation with:

FIG. 1, which shows a direct adaptive control of the state of the art;

FIG. 2, which shows an indirect adaptive control of the state of the art;

FIGS. 3.1 to 3.8, which show the forms 1 to 8 of application of modifier block to a nominal model to form augmented models with a representation as transfer functions or matrices, FIG. 4, which shows a scheme of an internal-model control in a state-observer representation/implementation, FIG. 5, which shows a scheme of an internal-model control in a transfer-function or matrix representation/implementation, FIG. 6, which shows an internal-model control law, with an augmented model of type 2 and a state-observer representation/implementation, FIG. **6*b* is, which shows a variant of the control law of FIG. 6, in which the gain $K_{c2}$ is constant and where an inverse block of the modifier block $\Delta(q^{-1})$ is included downstream of the gain $K_{c2}$, FIG. 7, which shows an internal-model control law with an augmented model of type 3 and a state-observer representation/implementation, FIG. 8, which shows an internal-model control law with an augmented model of type 5 and a state-observer representation/implementation, FIG. 9, which shows an internal-model control law with an augmented model of type 2 and a transfer-function or -matrix representation/implementation, FIG. 10, which shows a complete control law implementing two internal-model control laws with an augmented model of type 2, on the physical electroacoustic system and on a simulated model based on the nominal model, respectively, for calculation of the variable parameters, in particular those of the modifier block, thanks to a parametric adaptation algorithm, in a state-observer representation/implementation, FIG. 11, which shows a simplified version of a complete control law derived from the complete control law of FIG. 10 in a state-observer representation/implementation, FIG. 12, which shows a simplified version of the complete control law derived from the complete control law of FIG. 10 in a transfer-function or -matrix representation/implementation, FIG. 13, which shows a scheme of calculation of an additive noise b(k), and FIG. 14**, which shows an application of the invention with a multi-model control law in which a single nominal model is used and these are the variable elements of the control law that are subjected to a switching.

DETAILED DESCRIPTION OF THE INVENTION

The invention will now be described in detail, in particular through the principles that are implemented therein and the approach that is at the origin thereof.

As seen hereinabove, the multi-model control supposes the incorporation of a great number of correctors in the control law, which, taking into account the size of the correctors, easily leads to very high volumes of data and of calculation if n is high.

For its part, the adaptive control implements only one corrector with variable coefficients but the device for calculating these coefficients in line is so heavy that it is almost impossible to implement it in real time.

The present invention proposes a control law that is based on a single corrector, unlike the multi-model control, and whose greatest part of the coefficients is fixed, unlike the adaptive control.

The corrector is established based on a model of the electroacoustic system that is qualified as a nominal model, symbolized/represented by $M_o(q^{-1})$, just as its corresponding nominal transfer function, $q^{-1}$ being the delay operator of a sample period, this model being in this case expressed as a transfer function or a transfer matrix. It is to be noted that the explanations that are given in relation with the use of such a transfer function for the model are transposable to the use of a transfer matrix or also to the use of a state representation.

This nominal model is obtained by model identification when the system is in a nominal configuration that is also qualified as "median".

For a "median" configuration, it is understood:

In the case where the configuration of the space associated with the electroacoustic system is variable, for example an occupancy of a car passenger compartment, this comes to identify the model in a configuration corresponding to a "mean" occupancy of said space.

In the case of one/several loudspeaker(s) or one/several mobile microphone(s), the identification of the model is made, for example, with microphones in a central position, a position that is statistically the most frequent, etc.

The role of the model identification is to determine experimentally a discrete linear model sampled at the period Te between the controls U(k) and the measurements Y(k). As mentioned hereinabove, this nominal model $M_o(q^{-1})$ is generally expressed as a transfer function or, by transposition, as a transfer matrix or a state representation.

The identification of the nominal model, which is performed offline, i.e. not in real time, includes two phases:

1) An experimental phase consisting in sending on U(k), i.e. the loudspeaker(s), a rich-enough signal, called "persistent input" in automatics, intended to excite the electroacoustic system and to acquire in data files the values of the components of U(k) and Y(k), measured by the microphone (s), at each period Te in conditions of a median-configuration electroacoustic system in order to obtain the corresponding nominal model.

2) A phase of exploitation of the so-acquired data files by means of computer programs based on the mathematic optimization techniques to obtain the nominal model. The algorithms are numerous and reference can be made, if desired, to the following document: Ljung, "System identification, theory for the user", Prentice Hall 1987.

In case of use of a transfer function, it is considered that the transfer function of the physical/real/current electroacoustic system $\tilde{M}(q^{-1})$ (unknown by definition) diverges from the nominal transfer function $M_o(q^{-1})$, as the electroacoustic configuration may have evolved. It is to be noted that the case of transfer matrices can be applied equivalently to the case of the transfer function, just as for the state representation with $\tilde{M}(k)$ and $M_o(k)$.

If Y(k) is the signal coming from the error microphones and U(k) the control signal sent on the loudspeakers, the physical/real system is then expressed by:

$$Y(k)=\tilde{M}(q^{-1})\cdot U(k)$$

One of the aspects of the invention consists in considering that $\tilde{M}(q^{-1})$ can be expressed by means of the nominal transfer function or matrix $M_o(q^{-1})$, modified by a modification expressed by means of a modifying transfer function or transfer matrix $\Delta(q^{-1})$, corresponding to a modifier block in the representation. This modifying transfer function or matrix $\Delta(q^{-1})$ is functionally interconnected to $M_o(q^{-1})$ to apply the modification: this modifying transfer function or matrix $\Delta(q^{-1})$ hence applies to the nominal transfer function or matrix $M_o(q^{-1})$. That is this modifying transfer function or matrix $\Delta(q^{-1})$ that adapts itself, in real time, to the real conditions of the electroacoustic system, the nominal transfer function or matrix $M_o(q^{-1})$ remaining unchanged and being hence able to be calculated once for all, offline (not in real time), by model identification previously to the real time.

Various forms of augmented models exist, which are formed based on $M_o(q^{-1})$ and $\Delta(q^{-1})$, and some of these forms are presented in the following, without the list being exhaustive.

Form 1 shown in FIG. 3.1, in which the modifier block is placed at the entrance: $\tilde{M}(q^{-1})=M_o(q^{-1})\cdot\Delta(q^{-1})$ Form 2 shown in FIG. 3.2, in which the modifier block is placed at the exit: $\tilde{M}(q^{-1})=\Delta(q^{-1})\cdot M_o(q^{-1})$ Form 3 shown in FIG. 3.3, with an additive modification: $\tilde{M}(q^{-1})=M_o(q^{-1})+\Delta(q^{-1})$ Form 4 shown in FIG. 3.4, with a multiplicative modification at the entrance: $\tilde{M}(q^{-1})=M_o(q^{-1})\cdot(1+\Delta(q^{-1}))$ Form 5 shown in FIG. 3.5, with a multiplicative modification at the exit: $\tilde{M}(q^{-1})=(1+\Delta(q^{-1}))\cdot M_o(q^{-1})$ Form 6 shown in FIG. 3.6, with a multiplicative modification on the denominator at the entrance: $\tilde{M}(q^{-1})=M_o(q^{-1})\cdot(1+\Delta(q^{-1}))^{-1}$ Form 7 shown in FIG. 3.7, with a multiplicative modification on the denominator at the exit: $\tilde{M}(q^{-1})=(1+\Delta(q^{-1}))^{-1}\cdot M_o(q^{-1})$ Other forms of augmented models are possible, in particular some forms calling in the numerator and the denominator for the single-variable systems or the coprime factorization of the transfer matrix for the multi-variable systems, not only for the system $M_o(q^{-1})$ but also for the associated corrector.

For example, given $M_o(q^{-1})=D^{-1}(q)\cdot N(q)$ and given the corrector $C_{corr}=D_c^{-1}(q^{-1})\cdot N_c(q^{-1})$, the form 8 shown in FIG. 3.8, with a dual Youla parameterization, can be considered:

$$\tilde{M}(q^{-1})=\frac{N(q^{-1})+\Delta(q^{-1})\cdot N_c(q^{-1})}{D(q^{-1})-\Delta(q^{-1})\cdot D_c(q^{-1})}$$

The control law proposed in the present invention is based on the Morari internal-model control method presented in the document: Morari and Zafiriou, "Robust process control", Prentice Hall 1989. This internal-model control law also implements a disturbance observer.

In a first time, the principle of this control law will be described for the nominal system in single- and multi-variable mode, in a version intended for the rejection of narrow-band harmonic disturbances.

In order to simplify the explanations, the representation mode adopted herein is the state representation. However, the method explained hereinafter can be transposed to applications with transfer functions or transfer matrices.

The representation of the nominal model $M_o(k)$ is, k being the sample index:

$$X(k+1)=A\cdot X(k)+B\cdot U(k)$$

$$Ym(k)=C\cdot X(k)$$

with for this nominal system:

X(k) the state vector of size n at the current instant,

A (n*n) matrices of evolution,

B (n*nu), nu being the number of inputs, i.e. the number of loudspeakers,

C (ny*n), ny being the number of outputs, i.e. the number of error microphones.

It is to be noted that nu and ny are not necessarily equal to each other.

The parameters of A, B, C have been previously obtained by model identification as explained hereinabove.

The control law is written:

$$U(k)=-K_c \cdot X(k)-K_{c2} \cdot X_2(k)$$

where $X_2$ (k) is the state vector of a disturbance observer whose state equation is written:

$$X_2(k+1)=A_2 \cdot X_2(k)+K_{o2} \cdot (Y(k)-Ym(k)-C_2 \cdot X_2(k))$$

with:

$K_{c2}$ (nu,2*ny) a state feedback matrix for the disturbance observer, $K_c$ (nu*n) a state feedback matrix coming from a pole placement or a quadratic optimization (LQ), with reference to the document "Automatique appliquée" (second edition), Ph. De Larminat, and to the terminology described therein, $K_c$ must be calculated according to a pole placement of the PPB type or of optimization LQB to realize an inversion of the model, and the control law must be strictly an internal-model control law within the meaning of Morari. However, a choice of $K_c$ resulting from another procedure (that does not create an inversion of the model) is perfectly possible, without leading stricto sensu to the Morari scheme (which supposes an explicit or implicit inversion of the model).

$A_2$, $C_2$ evolution and output matrices of a predictor model of the harmonic disturbance $A_2$ ((2*ny)*(2*ny)) and $C_2$ (ny,2*ny).

If desired, reference can be made to the following document: "Contrôle d'état Standard", De Larminat, Hermès, 2000.

In the case of a harmonic disturbance, for a single-variable system, not damped at the frequency f, the following can be considered:

$$A_2=\begin{bmatrix} \cos(2\pi fTe) & -\sin(2\pi fTe) \\ \sin(2\pi fTe) & \cos(2\pi fTe) \end{bmatrix}$$

$$C_2=[1 \quad 0]$$

Having said that, any form obtained by a basic change is also valid. The model may also be that of a damped harmonic disturbance.

By taking $G(z)=C(z \cdot I-A-V \cdot K_c)^{-1}$. B with z an operator of the transform in z and $z_0=e^{j2\pi f \cdot Te}$ and $T_e$ a sample period, and for the values of $A_2$, $C_2$ given hereinabove:

$$K_{c2}=[\mathcal{R}e(G(z_0)^{-1}) \; \mathcal{I}m(G(z_0)^{-1})]$$

The equivalent scheme of the corresponding control law is given in FIG. 4. The loudspeaker(s) have been schematized in the physical/real system by the abbreviation HP and the error microphone(s) by the abbreviation MIC between brackets because the disturbing noise to be eliminated is schematized as entering into the control law more downstream, this displacement of the disturbing noise downstream of the microphone has no consequence: the noise being considered as an additive disturbance at the output of the system. In such applications, the reference signal that was on the left part in FIGS. 1 and 2 is now null, which explains that it does no longer appear on the left part of the following Figures.

In the case where a representation by transfer functions or matrices would be used, the internal-model control corresponds to the scheme of FIG. 5. In this FIG. 5, $N(q^{-1})$, $D(q^{-1})$ are the numerator and denominator of the transfer function, $N_s(q^{-1})$ being obtained such that it has for zeros all the stable zeros of $N(q^{-1})$ and the inverse of the instable zeros of $N(q^{-1})$. $N_2(q^{-1})$, $D_2(q^{-1})$ being the numerator and the denominator, respectively, of the disturbance observer.

As hereinabove, the control law presents a model of the system, herein the internal model of the nominal mode, and a disturbance observer expressed as a transfer function or a transfer matrix. Furthermore, the control law also includes the stable inverse of the nominal model. If $N(q^{-1})$ has instable zeros, these zeros are modified, for example by inversion with respect to the unit circle, to constitute $N_s(q^{-1})$, the denominator of the inverse of the nominal system model.

The internal-model control described hereinabove has naturally a good robustness, and a phase margin close to 90° may be reached during the rejection of a harmonic disturbance.

Now, if the transfer function of the physical/real electroacoustic system varies significantly, it is possible that, at one or several frequencies, the phase variation between the nominal model and the real secondary path transfer is, in absolute value, higher than the phase margin of the control law, hence resulting in an instability commonly called Larsen effect.

To remedy this problem and in order to increase significantly the robustness of the control, another aspect of the invention consists in exploiting the internal-model control structure in which the model of the system appears explicitly.

Hence, starting from the fact that the transfer function of the physical/real/current system $\tilde{M}(q^{-1})$ can be expressed based on the nominal function $M_o(q^{-1})$ on which is interconnected/applies a modifying transfer function $\Delta(q^{-1})$, a control law intended to the active acoustic control of narrow-band disturbing noises may be realized, in which a modifier block Δ as those presented hereinabove is used. It is then possible, by a method of identification in line, real time, to determine the coefficients of the modifier block Δ, because these latter are liable to vary over time unlike the nominal model and its nominal transfer function, or its nominal transfer matrix, or its nominal state representation according to the case.

Hence, in this control law, the matrices A, B, C, $K_c$, $A_2$, $C_2$ remain constant. Only the modifier block Δ is liable to have variable coefficients as well as $K_{c2}$, which is the state feedback matrix of the disturbance observer (see hereinafter), also called state feedback gain or, more simply, gain herein.

All the interest of this control law can be seen: the great majority of the coefficients are fixed and hence calculated offline, unlike the conventional adaptive control, the adaptation concerning the modifier block A, which is an infinite impulse response, IIR, filter, or a finite impulse response, FIR, filter, but of limited dimensions with, for example, 3 or 4 coefficients for a FIR in a single-variable system.

For that reason, this control law may be called: "semi-adaptive internal-model control law", by opposition to the conventional adaptive control where all the coefficients of the corrector have to be recalculated at each sampling period, hence in real time, which produces, as said hereinabove, a prohibitive volume of calculation. Herein, on the opposite, the adaptation concerns only a very small number of coefficients and the volume of calculation of the coefficients of the modifier block $\Delta$ and of those of $K_{c2}$ is significantly reduced with respect to the hundred or more coefficients of a conventional adaptive control law.

For example, a single-variable control law may be defined, with four coefficients for the modifier block and two coefficients for $K_{c2}$. There results therefrom that the volume of calculation required for the adaptation of the parameters is not much greater than that of the conventional internal-model control law, unlike the multi-model control in which the volume of calculation is equal to the volume of a corrector multiplied by the number of models used.

Among all the forms of augmented models usable, some among those described hereinabove are preferred for an implementation within the framework of the invention. The preferred forms are the forms of type 2, 3, 5, 7 and 8, although other ones may be used.

In the case of the augmented model of type 2, the control law is given in FIG. 6. In the figures, the variable elements are those on which an inclined arrow is shown.

In the case of the augmented model of type 3, the control law is given in FIG. 7.

In the case of the augmented model of type 5, the control law is given in FIG. 8.

Hence, for each augmented model, a specific control law exists.

This type of structure of control law may be considered as an internal-model control law, however the law described by Morari would suppose an integration of a stable inverse of $\Delta(q^{-1})$ into the control law.

One of the difficulties is to calculate this stable inverse of the modifier block. Several solutions to that problem exist. This stable inverse may be simply omitted and that is the preferred solution that is presented herein. As an alternative, a fixed-parameter filter may be put in lieu and place of this inverse, or the coefficients of this stable inverse may be explicitly calculated, which however requires more significant calculations.

As a variant of the scheme proposed in FIG. 6, it is proposed in FIG. 6*b* is a control structure where the gain $K_{c2}$ is constant but where an inverse block of the block $\Delta(q^{-1})$ is included downstream of $K_{c2}$. This block, as said hereinabove, must be stable and may be a finite or infinite impulse response filter.

When considering the conventional internal-model control, the gain $K_{c2}$ is calculated based on the complex transmittance of:

$$G(z)=C(z\cdot I-A-B\cdot K_c)^{-1}\cdot B \text{ and } z_0=e^{j2\pi f\cdot Te}$$

and it is determined by means of:

$$K_2=[\mathcal{R}e(G(z_0)^{-1})\ \mathcal{I}m(G(z_0)^{-1})]$$

supposing $A_2$ and $C_2$ with the values as given hereinabove.

In the case of an augmented model of type 2: $G(z_0)=\Delta(z_0)\cdot C(z_0\cdot I-A-B\cdot K_c)^{-1}\cdot B$ In the case of an augmented model of type 3: $G(z_0)=C(z_0\cdot I-A-B\cdot K_c)^{-1}\cdot B+\Delta(z_0)$ In the case of an augmented model of type 5: $G(z_0)=(1+\Delta(z_0))\cdot C(z_0\cdot I-A-B\cdot K_c)^{-1}\cdot B$ In the case of an augmented model of type 7: $G(z_0)=(1+\Delta(z_0))^{-1}\cdot C(z_0\cdot I-A-B\cdot K_c)^{-1}\cdot B$ Hence, for example, in the case of a transfer function representation, the scheme of the control law in the case of an augmented model of type 2, is given in FIG. 9. It can be noted that only the numerator $N_2(q^{-1})$ varies when $\Delta(q^{-1})$ evolves in the disturbance observer block.

In this control law, the modifier block $\Delta(q^{-1})$ must be identified/calculated in real time just as the disturbance observer block.

In the following will described by way of example the identification device in the case where a model of type 2, supposing that $\Delta(q^{-1})$ is a finite impulse response (FIR) filter, without, here again, being limitative.

The proposed algorithm is a closed-loop identification algorithm, which is natural because $\Delta(q^{-1})$ is inserted in a closed loop. However, an open-loop identification algorithm may possibly be used, even if it will give less accurate, or even biased, results, due to a possible correlation between the measurement noise and the input of the system to be identified.

The proposed scheme of identification is derived from the CLOE ("closed loop identification") algorithm explained by I.D. LANDAU et al. in the document: "An output error recursive algorithm for unbiased identification in closed loop", Automatica 33(5): p 933-938. Other algorithms may however be used.

In the specific case of use of the augmented model of type 8, it may be used by way of example the Hansen method based on the dual Youla parameterization, which has been presented in the document: Hansen et al. "Closed Loop Identification via the functional representation: Experimental design", Proc. of American Control conference 1989, p. 1422-1427 (1989).

The principle, that is proposed herein by way of example, of this algorithm consists in simulating in real time and in parallel to the closed loop of the physical/real system provided with its corrector, said closed loop but with its nominal model. Supposing a configuration of type 2, we have then the complete control law of FIG. 10, the coefficients of $\Delta(q^{-1})$ being determined based on the error $\epsilon$ between Ys and Y, i.e. $\epsilon=Y-Y_s$, by means of an parametric adaptation algorithm used for a closed-loop identification forming a parametric adaptation block.

Hence, the modifier block is varied in real time as a function of the results of a parametric adaptation by a closed-loop identification, in real time, between, on the one hand, the internal-model control law applied to the physical/real electroacoustic system 1 (the control law in the top part of FIGS. 10 to 12), and on the other hand, the internal-model control law applied to the modelled and nominal electroacoustic system 2 resulting from the previous model identification of the nominal system and with application of the modifier block to said nominal model in replacement of the disturbing noise(s) P(k) or $P(z^{-1})$ (the control law in the low part of FIGS. 10 to 12).

In FIG. 10 the complete control law has been shown using the state representation. It can be observed in the top part of FIG. 10 a portion of the complete control law that corresponds to an internal-model control law concerning the physical/real system and in the low part a control law close to the previous internal-model control law but where the model of the real system is simulated using the previously identified nominal model, to which is adjoined the modifier block. The real time behaviours/responses of these two internal-model control law are used by the parametric adaptation algorithm (intermediate part in FIG. 10), to allow the calculation of the coefficient $\Delta(k)$ and of the gain $K_{c2}$.

The signal w(k) corresponds to the output of the nominal model simulated in the low part of FIGS. 10 to 12.

The signal b(k) corresponds to an additive noise introduced in the closed loop.

The control law shown in FIG. 10 may be simplified to obtain that shown in FIG. 11, also corresponding to the use of a state representation. In the case where this same simplified control law is expressed by means of transfer functions or transfer matrices, the scheme of the control law of FIG. 12 is obtained.

The parametric adaptation algorithm is the algorithm that allows the closed-loop identification in line of the coefficients of $\Delta(q^{-1})$ or $\Delta(k)$ according to the modality used: by transfer function(s), transfer matrices or by state representation.

Let's suppose, in a first time, that the system to be controlled is single-variable. In this case, $\Delta(q^{-1})$ is itself single-variable. It is chosen, for the example, that $\Delta(q^{-1})$ is a FIR (finite impulse response) filter, without being limitative.

This filter may then be written: $\Delta(q^{-1})=\theta_0+\theta_1\cdot q^{-1}+\theta_2\cdot q^{-2}+\ldots+\theta_{n\Delta}\cdot q^{-n\Delta}$ with $n\Delta$ the order of the filter.

If considering the augmented model of type 2: $Y_s(k)=\Delta(q^{-1})\cdot w(k)$.

The observation vector $\phi(k)^T=[w(k+1)\ w(k)\ldots w(k-n\Delta+1]$ is defined, where w(t) is the input signal of the filter $\Delta(q^{-1})$ in the simulation portion of the closed loop (low part of FIG. 12), this definition being specific to the augmented model of type 2.

The parameter adaptation algorithm allows to determine the vector $$\Theta=\begin{bmatrix}\theta_0\\ \vdots\\ \theta_{n\Delta}\end{bmatrix}$$

of the coefficients of the filter by means of the following recurrence relation implemented in real time:

$$\theta(k+1)=\theta(k)+\frac{F(k)\cdot\phi(k)\cdot(\varepsilon(k+1))}{1+\phi(k)^T\cdot F(k)\cdot\phi(k)}$$

$\epsilon(k+1)=Y(k+1)-Y_s(k+1)$, this equation being specific to the augmented model of type 2, and the matrix F(t) being an adaptation gain which, in general, is defined by the following recurrence relation:

$$F(k+1)^{-1}=\lambda_1(k)\cdot F(k)^{-1}+\lambda_2(k)\cdot\phi^T(k)\cdot\phi(k)$$

and with $\lambda_1(k)$ and $\lambda_2(k)$, which are scalars named forgetting factors allowing to set the rapidity of convergence of the algorithm.

In the case where $\Delta(q^{-1})$ is an infinite impulse response filter, the observation filter must further include the outputs of said filter at the instants k, k−1, k−2, etc. When the system is multi-variable, $\Delta(q^{-1})$ becomes itself multi-variable, and this is hence a transfer matrix.

The output vector is written:

$$Y(k)=\begin{bmatrix}Y_1(k)\\ \vdots\\ Y_{ny}(k)\end{bmatrix}$$

Likewise:

$$Y_s(tk)=\begin{bmatrix}Y_{s1}(k)\\ \vdots\\ Y_{sny}(k)\end{bmatrix}$$

$n_y$ errors are defined, corresponding to $n_y$ error signals and $\epsilon_i(k)=Y_i(k)-Y_{si}(k)$ for the augmented model of type 2. We have then $n_y$ parametric adaptation algorithms operating in parallel.

It is to be noted that the parametric adaptation mechanism exists in various variants, in particular the matrix F may be chosen constant, the algorithm is then equivalent to the recursive gradient algorithm.

Moreover, the components of the vector $\phi(k)$ may be subjected to a filtering, and from this point of view, the form presented is not limitative.

Finally, as the frequency zone in which more and more accuracy is needed is about the rejection frequency of the disturbing noise, it may be interesting to filter the vectors $Y_s(k)$ and Y(k) by band-pass, possibly band-cut, filters, upstream of the parametric adaptation algorithm.

It is to be noted that is necessary to introduce an additive noise b(k) in the loop so that the looped system is subjected to a persistent excitation, independently of the disturbing noise b(k).

The device for controlling the variance of b(k) disclosed in the already mentioned patent application FR12/62353 may opportunely be implemented. This variance control device allows to regulate the level of additive noise as a function of the residual variance of Y(k).

The additive noise is added to the error between said output and the output of the augmented model $Y(k)-Ym_a(k)$. The same additive noise being itself injected in the same place in the simulated closed loop (low part of FIGS. 10 to 12 according to the cases) for the closed-loop identification.

The effect of this additive noise b(k) on Y(k) may be expressed by means of the so-called "complementary sensitivity" transfer function T(z).

For the control law based on the nominal model: $T(z)=C(zI-A+B\cdot Kc)^{-1}B\cdot K_{c2}(zI-A_2+K_{o2}\cdot C_2)^{-1}K_{o2}$ The additive noise b(k) is not necessarily a white noise, but may be obtained from a white noise filtered by a forming filter $F_{fb}$, i.e.:

$b(k)=F_{fb}(q^{-1})\cdot b_b(k)$ with $b_b(k)$ a white noise.

Moreover, the disturbing noise P(k) may also be modelled as a white noise passed through a forming filter $F_{fp}$, i.e.:

$P(k)=F_{fb}(q^{-1})\cdot e(k)$ with e(t) a white noise independent of $b_b(k)$.

It is possible, still for the control law based on the nominal model of type 2, to express Y(k) as follows:

$$Y(k)=(I-T(q^{-1}))\cdot F_{\hat{f}p}(q^{-1})\cdot e(k)+T(q^{-1})\cdot F_{fb}(q^{-1})\cdot b_b(k)$$

As e(k) and $b_b(k)$ are two white noises of variance 1 and decorrelated from each other, it may be written:

$$E[Y(k)^2]=|(I-T)\cdot F_{\hat{f}p}|_2^2\cdot E[e(k)^2]+|T\cdot F_{fb}|_2^2\cdot E[b_b(k)^2]$$

where $|\ldots|_2$ is the norm 2 of a transfer function and $E[x(k)^2]$ is the variance of the signal x(t).

Hence, in order to adapt the level of additive noise b(k) from the level of residual disturbing noise on Y(k), it is possible to estimate the variance $\hat{E}[Y(k)^2]$ of Y(k), by calculating the square of this signal and filtering it by a low-pass filter of static gain 1. The variance of the white noise $[b_b(k)^2]$ of $b_b(k)$ may then be defined based on the following proportional law:

$$E[b(k)^2]=(|T\cdot F_{fb}|_2^2)^{-1}\cdot Kp\cdot\hat{E}[Y(k)^2]$$

where $K_b$ is a proportional gain preferably comprised between 0 and 0.5 in the single-variable case and a diagonal matrix whose terms are preferably comprised between 0.5 and 0 in the multi-variable case.

The scheme of principle of this variance control is given in FIG. 13.

It is to be noted that the method and the corresponding system presented may be extended to the case where the disturbing noise is of a frequency that is slowly variable about the value fpert: the only adjustment to be made with respect to the case where fpert is fixed consists in recalculating as a function of said frequency, the matrices $A_{02}$, $C_{02}$, $K_{o2}$, whose values may be tabulated as a function of fpert, which is supposed to be known or determinable in real time (for example if the disturbing noise is linked to the rotational speed of a machine, speed that can be measured in real time).

The method may also be extended to the case where the number of frequencies of the disturbing noise is greater than 1. Let's call $n_f$ the number of disturbing noise bands, then the order of the disturbance observer is equal to $2 \cdot n_f$.

It is also possible to use the fact that the method/system presented herein realizes permanently/in real time a closed-loop identification of $\Delta(q^{-1})$ or $\Delta(k)$, so as to store/memorize, during the use of this control law, the values of the coefficients of $\Delta(q^{-1})$ or $\Delta(k)$ for each configuration of the electroacoustic system, for example for m places of the microphones and/or of the loudspeakers (if these latter are mobile). Said coefficients corresponding to the m places can then be stored in tables for a later use when the same configuration of the electroacoustic system will be found.

It is then used a control law of the multi-model type, for example derived from that described in the patent application FR12/62353 or, more generally, according to the methods presented in the document: Landau et al., "Adaptive control", Springer, 2011, but where the corrector switching concerns only the block $\Delta(q^{-1})$ or $\Delta(k)$ and $K_{c2}$ and/or possibly the stable inverse of $\Delta$ and/or the disturbance observer according to the implemented modality (in particular with or without stable inverse $\Delta$ or variable gain or not . . . ), following a switching logic as found in the patent application FR12/62353, i.e. based on external information (for example, from sensors of position of the microphones or of a person), or by comparison of the various models with respect to the effective behaviour of the physical/real system. Hence, the selection of the modifier bloc, of the gain and/or of the stable inverse of the modifier block and/or of the disturbance observer to be used in real time depends on selection means that are external (position sensors, for example) and/or internal (by comparison between the response of the real system and the different correctors for selecting the most suitable). The main advantage of this control law with respect to the multi-model law described in the patent application FR12/62353 is to minimize the volume of calculation of the multi-models. A scheme of this type of control law is given in FIG. 14. In this modality of implementation of the multi-model, a single nominal model is used.

The acquisition/memorization of the variable elements, i.e. of the modifier block, the gain and/or the stable inverse of the modifier block and/or the disturbance observer may be made previously to the real time, for example just after the identification of the nominal model in a previous phase of configuration of the control law. It may also be done (to complete the variable elements already memorized), or as an alternative, in real time: each time a new modifier block and/or gain and/or inverse of a modifier block and/or the disturbance observer is calculated in real time, these latter are memorized for a later use. It is understood that, if external selection means are used, it is useful to memorize with each variable element, the measurement provided by the external selection means (for example, the position of the microphone corresponding to the variable element calculated at this time), so as to allow the later selection of the adapted memorized variable elements. It is hence possible to make a system that becomes finer over time and/or that adjusts itself to changing conditions. It is understood that it is also possible to implement optimization means allowing to memorize only the more significant/useful variable elements calculated so as to avoid the saturation of the memory of the calculation means. The active control method of the invention hence implements signal processings based at least on measurements (measurement signal(s) coming from error microphones), to produce counter-noises thanks to the calculation of one/several control signals applied to one/several loudspeakers. The space corresponding to the electroacoustic system in which the active control method acts is essentially continuous by nature. Analog signal processings (analog means of calculation by a linear electronic) could also be contemplated. However, the processings/calculations to be performed are relatively complex and it is hence preferred to implement digital means for processing the signals. Hence, the processing/calculation means are preferably programmable digital devices, for example computer devices such as digital signal processor or computer/server with interfaces adapted for converting the analog signal into digital signals and vice-versa. It results therefrom that the initially analog signals coming from the electroacoustic system are sampled over time due to digital acquisitions of those analog signals. The digital signals processed and produced are hence sampled in the digital calculation means. Furthermore, auxiliary devices for signal conditioning (filtering, pre-amplification, amplification . . . ) may be implemented.

Preferably, it is implemented a calculation means that is of the programmable computer type with a digital signal microprocessor or processor (DSP) that hence operates under the control of a computer program that is on a computer medium (read-only memory, random-access memory, removable memory medium . . . ).

If the method proposed by the invention allows to simplify the practical implementation of the active acoustic control of disturbing noises in case of modification over time of the electroacoustic system and hence of the corresponding model, the method may also be used in conditions of invariance of the electroacoustic system.

Moreover, in particular in the case where the electroacoustic system varies because a person carrying one/several error microphones moves in the space corresponding to the electroacoustic system, the method of the invention may be applied in combination with a multi-model control as seen, or in a still-wider application, with implementation of several nominal models and several modifier blocks (and gain and/or inverse of $\Delta$ and/or disturbance observer) for each nominal model, the most-suitable nominal model (and its modifier block(s)+gain . . . ) being selected in real time: each corresponding model and corrector is of the modifier block type according to the present invention and the model/corrector applied in real time is chosen according to the multi-model control, for example according the principles presented in the patent application FR12/62353, or more generally, according to the methods presented in the document: Landau et al., "Adaptive control", Springer, 2011. Thanks to this combination, the number of points of reference of the space where an identification must be made (in case of moving of one/several error microphones) to obtain the nominal model (because the model and the corrector are obtained according to the principles of the present invention) is reduced with respect to a convention application of a multi-model control, without counting the gain in terms of calculations.

More generally, it is understood that the invention may be applied to any source of disturbing noise or concerned space, as for example mechanical vibrations in physical structures or a physical space other than aerial, such as a marine medium, the loudspeakers and microphones being changed for elements adapted to this other space.

The invention claimed is:

1. An active acoustic control method for attenuating in frequency one/several narrow-band disturbing noises in a configuration of a space, said space including:

at least one source of narrow-band disturbing noise, at least one counter-noise loudspeaker intended to produce a counter-noise in said space as a function of a loudspeaker control signal U(k), and at least one error microphone intended to measure the sounds in said space and producing a measurement signal Y(k), the attenuation occurring essentially in the vicinity of the error microphone(s), said space with its loudspeaker(s) and its microphone(s) forming a physical electroacoustic system, said method including a calculation in real time, in a calculator, of the control signal U(k) as a function of the measurement signal according to a control law with internal model and disturbance observer, said control law implementing a model of the electroacoustic system, wherein said model of the electroacoustic system has been previously obtained by a model identification method, wherein the current configuration of the physical electroacoustic system is varied over time, which leads to a modification of the current model $\tilde{M}(q^{-1})$ or $\tilde{M}(k)$ of the physical electroacoustic system with respect to the previously identified model, a nominal configuration of said physical electroacoustic system is previously determined and a so-called nominal model $M_o(q^{-1})$ or $M_o(k)$ corresponding to said nominal configuration of said physical electroacoustic system is previously identified, and the internal-model and disturbance-observer control law in which a modifier block $\Delta(q^{-1})$ or $\Delta(k)$ is associated with the nominal model is implemented in real time, said modifier block being interconnected/applying to said nominal mode, and the nominal model is left unchanged during the variations of the current configuration of the physical electroacoustic system and the modifier block is varied in real time during the variations of the current configuration of the physical electroacoustic system so as to adapt in real time the internal-model control law to the current configuration of the physical electroacoustic system, the current model $\tilde{M}(q^{-1})$ or $\tilde{M}(k)$ of the current configuration of the physical electroacoustic system being considered as being equal to the nominal model $M_o(q^{-1})$ or $M_o(k)$ interconnected to the modifier block $\Delta(q^{-1})$ or $\Delta(k)$.

2. The method according to claim 1, wherein the internal-model and disturbance-observer control law is feedback based.

3. The method according to claim 1, wherein a Morari internal-model control method is implemented and, preferably, in said Morari internal-model control law, the stable inverse of the modifier block is omitted.

4. The method according to claim 1, wherein the modifier block is chosen among the finite impulse response filters or the infinite impulse response filters.

5. The method according to claim 1, wherein the application of the modifier block to the nominal model corresponds to one of the following operations:

modifier block placed at the entrance:

$$\tilde{M}(q^{-1})=M_o(q^{-1})\cdot\Delta(q^{-1})$$

modifier block placed at the exit:

$$\tilde{M}(q^{-1})=\Delta(q^{-1})\cdot M_o(q^{-1})$$

additive modification:

$$\tilde{M}(q^{-1})=M_o(q^{-1})+\Delta(q^{-1})$$

multiplicative modification at the entrance:

$$\tilde{M}(q^{-1})=M_o(q^{-1})\cdot(1+\Delta(q^{-1}))$$

multiplicative modification at the exit:

$$\tilde{M}(q^{-1})=(1+\Delta(q^{-1}))\cdot M_o(q^{-1})$$

multiplicative modification on the denominator at the entrance:

$$\tilde{M}(q^{-1})=M_o(q^{-1})\cdot(1+\Delta(q^{-1}))^{-1}$$

multiplicative modification on the denominator at the exit:

$$\tilde{M}(q^{-1})=(1+\Delta(q^{-1}))^{-1}\cdot M_o(q^{-1})$$

dual Youla parameterization:

$$\tilde{M}(q^{-1})=\frac{N(q^{-1})+\Delta(q^{-1})\cdot N_c(q^{-1})}{D(q^{-1})-\Delta(q^{-1})\cdot D_c(q^{-1})}$$

with $$M_o(q^{-1})=D^{-1}(q)\cdot N(q)$$

and considering a corrector $$C_{corr}=D_c^{-1}(q^{-1})\cdot N_c(q^{-1}).$$

6. The method according to claim 1, wherein the modifier block varies in real time as a function of the results of a parametric adaptation by a closed-loop identification performed in real time/in line between, a) the internal-model control law applied to the physical electroacoustic system (1) and b) the internal-model control low applied to the modelled and nominal electroacoustic system (2) resulting from the previous identification of the nominal system and with application of the modifier block to said nominal model in replacement of the disturbing noise(s) P(k).

7. The method according to claim 1, wherein the method of previous identification of the nominal model consists, firstly, in exciting the electroacoustic system in its nominal configuration with an excitation control signal and in measuring the response of said system by the measurement signal while recording said signals, and secondly, in exploiting said recorded signals with a method of identification to produce the nominal model.

8. The method according to claim 1, wherein the nominal model is expressed as a transfer function or as a transfer matrix or by a state representation.

9. The method according to claim 1, wherein a multi-model control law is further implemented with a memory that memorizes a set of variable elements of the control law, including the modifier block, and a selector that selects elements in real time among said variable elements so as to select for the control law the variable elements corresponding to the current state of the physical electroacoustic system.

10. An active acoustic control system intended to attenuate in frequency one/several narrow-band disturbance noises in a configuration of a space, said space including:

at least one source of narrow-band disturbing noise, at least one counter-noise loudspeaker intended to produce a counter-noise in said space as a function of a loudspeaker control signal U(k), and at least one error microphone intended to measure the sounds in said space and producing a measurement signal Y(k), the attenuation occurring essentially in the vicinity of the error microphone(s), said space with its loudspeaker(s) and its microphone(s) forming a physical electroacoustic system, the system including a calculator which calculates in real time the control signal U(k) as a function of the measurement signal according to a control law with internal model and disturbance observer, said control law implementing a model of the electroacoustic system, wherein said model of the electroacoustic system has been previously obtained by a model identification method, wherein the current configuration of the physical electroacoustic system varies over time, which leads to a modification of the current model $\tilde{M}(q^{-1})$ or $\tilde{M}(k)$ of the physical electroacoustic system with respect to the previously identified model, a nominal configuration of said physical electroacoustic system having been previously determined and a so-called nominal model corresponding to said nominal configuration of said physical electroacoustic system having been previously identified, the system includes a calculator configured for implementing in real time the control law with internal model and disturbance observer in which a modifier block that applies to said nominal model is associated with the nominal model, and said calculator leaving unchanged the nominal model during the variations of the current configuration of the physical electroacoustic system and varying in real time the modifier block during the variations of the current configuration of the physical electroacoustic system so as to adapt in real time the control law to the current configuration of the physical electroacoustic system, the current model $\tilde{M}(q^{-1})$ or $\tilde{M}(k)$ of the current configuration of the physical electroacoustic system being considered as being equal to the nominal model $M_o(q^{-1})$ or $M_o(k)$ on which applies to the modifier block $\Delta(q^{-1})$ or $\Delta(k)$.

11. A non-transitory recording medium readable by a computer on which is recorded a computer program comprising program code instructions for performing steps of the method of claim 1.

* * * * *